United States Patent [19]

Bernhardt

[11] Patent Number: 4,488,880

[45] Date of Patent: Dec. 18, 1984

[54] PROCESS FOR THE REOXIDATION OF DYEINGS MADE WITH SULFUR DYESTUFFS

[75] Inventor: Heinrich Bernhardt, Kriftel, Fed. Rep. of Germany

[73] Assignee: Hoechst Aktiengesellschaft, Fed. Rep. of Germany

[21] Appl. No.: 594,681

[22] Filed: Mar. 29, 1984

[30] Foreign Application Priority Data

Apr. 2, 1983 [DE] Fed. Rep. of Germany ..... 3312162
Oct. 21, 1983 [DE] Fed. Rep. of Germany ..... 3338267

[51] Int. Cl.[3] ..... C09B 49/00; D06P 5/06; D06P 1/30

[52] U.S. Cl. ..... 8/652; 8/593; 8/918

[58] Field of Search ..... 8/652

[56] References Cited

U.S. PATENT DOCUMENTS

| | | | |
|---|---|---|---|
| 3,716,325 | 2/1973 | Aspland | 8/652 |
| 3,944,382 | 3/1976 | Doerr | 8/652 |
| 4,011,042 | 3/1977 | Stitzel | 8/652 |
| 4,012,192 | 3/1977 | Doerr | 8/652 |
| 4,036,586 | 7/1977 | Rowe | 8/652 |
| 4,131,423 | 12/1978 | Kato | 8/652 |
| 4,310,332 | 1/1982 | Curzons | 8/652 |
| 4,321,054 | 3/1982 | Davis et al. | 8/652 |
| 4,371,373 | 2/1983 | Balland | 8/652 |
| 4,394,129 | 7/1983 | Springer | 8/543 |
| 4,397,649 | 8/1983 | Springer | 8/436 |

*Primary Examiner*—A. Lionel Clingman
*Attorney, Agent, or Firm*—Connolly and Hutz

[57] ABSTRACT

The reoxidation of sulfur dyestuffs in an acid medium is associated with disadvantages, such as pollution of the environment, the risk of corrosion on equipment etc. Admittedly oxidation in an alkaline medium does not have these disadvantages, but it is, in turn, more difficult to control (dependence on pH and constancy of color shade).

These difficulties are eliminated in accordance with the invention if the textile material containing cellulose fibers which has the sulfur dyestuffs in the reduced form applied and fixed thereto is subjected to the oxidative action of sodium benzenesulfochloroamide or p-toluenesulfochloroamide under alkaline conditions in order to develop the dyestuff. This can be carried out either continuously or discontinuously.

11 Claims, No Drawings

PROCESS FOR THE REOXIDATION OF DYEINGS MADE WITH SULFUR DYESTUFFS

The present invention relates to a process for the reoxidation, from an alkaline medium, of sulfur dyestuffs which have previously been applied, in a reduced form, to a textile material containing cellulose fibers and have been fixed thereto.

The dyeing of cellulose-containing textiles with sulfur dyestuffs, both continuously or discontinuously, is adequately known. Regardless of whether the starting materials for this are the actual sulfur dyestuffs (C.I. Sulfur Dyes) or the soluble sulfur dyestuffs (C.I. Leuco Sulfur Dyes, C.I. Solubilized Sulfur Dyes) or vat sulfur dyestuffs (C.I. Vat Dyes), it is necessary in every case, for developing the dyestuff, to reoxidize, after application to the material to be dyed, the dyestuff which has been applied/absorbed in the reduced form of a substantive leuco compound.

Various processes have already been suggested for this reoxidation which is required to convert the soluble leuco form into the insoluble sulfur dyestuff, but these processes are subject, under practical conditions, to the difficulties mentioned below:

The most customary process is the reoxidation of leuco dyestuffs by means of an alkali metal dichromate and acetic acid. This mode of oxidation in an acid medium takes place rapidly and completely; it is also only slightly dependent on the pH. On the other hand, a procedure of this type has the disadvantages, which are becoming increasingly important in view of the ever stricter directions of effluent legislation relating to the prevention of environmental pollution, that the effluent is polluted with toxic heavy metal salts and the mechanical equipment is exposed to corrosion as a result of this acid oxidation. The last point applies, moreover, to all oxidation processes in an acid medium. In addition, the re-wettability of the dyed material is impaired by the oxidation with potassium dichromate/acetic acid.

Although the oxidation of leuco dyestuffs by means of hydrogen peroxide in an alkaline medium does not have the drawbacks discussed above, a rigid dependence on the pH can be observed in a process of this type. This pH dependence has an unfavorable effect on the tinctorial result in the sense of undesirable variations in color shade within oxidation batches or from one batch to another.

In addition, if the process is carried out continuously, there is also the fact that, in the case of the acid oxidation, problems are caused by the metering of the oxidizing agent and the acid. Similarly, no substantial improvement in tinctorial yields are afforded by adding catalysts in the oxidation process using hydrogen peroxide in an alkaline medium.

Subjecting cellulose fiber material which has been dyed or printed with sulfur dyestuffs to oxidative aftertreatment with the oxygen of the atmosphere, using a quinonoid reoxidation catalyst, is thus known from German Offenlegungsschrift No. 2,434,095. This technique has, however, remained unimportant for practical purposes.

Yet again, German Offenlegungsschrift No. 2,652,779 describes a reoxidation process in which the goods which have been treated with previously reduced sulfur dyestuffs are oxidized by the action of an iodate or bromate and with the aid of a vanadate as a catalyst. It is preferable to add a nitrate to the oxidation bath as a corrosion inhibitor. Apart from the relatively high cost of the oxidizing agents, in this case also the problem of dyestuff constancy and corrosion risk has not been overcome.

Finally, the continuous method, described in German Pat. No. 2,641,777, for the reoxidation, in an alkaline medium and using hypochlorites, of dyeings made with sulfur dyestuffs has not been able to gain acceptance owing to the considerable problems involved in metered addition of the oxidants and the great prejudices against oxidizing sulfur dyestuffs with hypochlorite. In addition, this known process involves considerable difficulties in respect of reproducing the measures taken to oxidize the dyestuffs.

It was therefore the object of the present invention to develop a novel oxidation process for sulfur dyestuffs which is not afflicted by the abovementioned disadvantages of the conventional processes and which involves little environmental pollution. The process should, additionally, be capable of operation either continuously or discontinuously and should ensure the necessary reliability with regard to the constancy of the resulting color shade.

This object is achieved, in accordance with the invention, by exposing the fiber material which has been treated with the dyestuffs to the oxidative action of an aqueous solution of N-halogenated organic sulfonamides of the general formula $$R-SO_2-\underset{\underset{X}{|}}{N}-Hal$$

in which R denotes an aryl radical, preferably phenyl, or a lower alkylaryl radical, preferably mono-($C_1$–$C_4$)-alkylphenyl or di-($C_1$–$C_4$)-alkylphenyl, Hal represents a halogen atom, particularly chlorine, but also bromine, and X represents a hydrogen atom or an alkali metal atom, preferably sodium, at a temperature between 15° and 98° C. and at pH values within the range from 9 to 12. The reoxidation is preferably carried out within the pH range between 8 and 10.

The sodium salts of benzenesulfonic acid N-chloroamide (Chloramine B) and of p-toluenesulfonic acid N-chloroamide (Chloramine T), which produce equivalent tinctorial results, may be mentioned in particular as representatives, suitable in accordance with the invention of such N-halogenoarylsulfonamides and N-halogenoalkylarylsulfonamides which are capable of releasing positively charged halogen in the oxidation process. Compounds of this type are described, inter alia, in Ullmanns Encyklopädie der technischen Chemie ("Ullmann's Encyclopedia of Industrial Chemistry"), 4th Edition, volume 9, pages 384–392 (especially pages 388–389) and in Kirk-Othmer, Encyclopedia of Chemical Technology, Third Edition, Volume 5, pages 565–580 (especially pages 574–575).

By virtue of the gentle oxidative action of sodium benzenesulfochloroamide or p-toluenesulfochloroamide which takes place in accordance with the present invention under the alkaline pH conditions indicated, a rapid and complete oxidation of the leuco compounds present on the fiber material is achieved without the development of the dyestuff being subject to the impairment which is familiar from the state of the art. In the case of sulfur black dyeings it is also a factor of importance that the result of the reoxidation being carried out in the alkaline pH range is to reduce significantly the risk of the fibers being damaged if the finished dyeings are stored.

Since the time factor is not of major importance in the oxidation procedure according to the invention, the process claimed can be carried out either continuously or discontinuously. In the case of continuous operation, dwell times of the material to be dyed of between 5 and 120 seconds are adequate.

In this respect it is completely irrelevant in what form the sulfur dyestuffs have been applied to the textile materials to be dyed, whether they have been applied as vatted sulfur dyestuffs, leuco sulfur dyestuffs or as sulfur dyestuffs which have been rendered soluble by means of thiosulfato groups. Irrespective of the method of application, they are present after fixing in a reduced form on the fiber and must therefore be reoxidized to give the insoluble dyestuff.

In sodium benzenesulfochloroamide (Na N-chlorobenzenesulfonamide) and sodium p-toluenesulfochloroamide (Na N-chloro-4-toluenesulfonamide) of the formulae

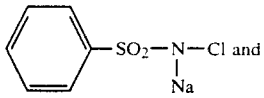

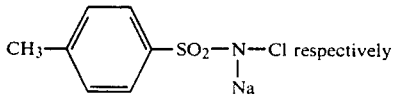

there are available to the dyeing industry for the development of sulfur dyestuffs low-cost, physiologically acceptable oxidizing agents having end products which are unobjectionable from the point of view of effluent technology. Their metered addition causes no problems and no difficulties are encountered in maintaining constancy of color. Even sulfur dyestuffs which are oxidizable only with difficulty are rapidly and completely reoxidized. The risk of corrosion is eliminated by means of the process. The simultaneous use of reoxidation catalysts is superfluous in the course of the claimed oxidation method.

Since sodium p-toluenesulfochloroamide acts via the elimination of sodium hypochlorite in accordance with the equilibrium reaction (reaction mechanism indicated in the free acid form)

$$CH_3-C_6H_4-SO_2-NHCl + H_2O \rightleftharpoons CH_3-C_6H_4-SO_2-NH_2 + HOCl$$

the deep-seated prejudice, already mentioned above, against any treatment using hypochlorites applied to dyeings with sulfur dyestuffs was capable of being overcome. An analogous behavior applies to sodium benzenesulfochloroamide.

For carrying out the process according to the invention in practice, it is possible to mix pulverulent sodium benzenesulfochloroamide or p-toluenesulfochloroamide with a dispersing agent, for example of the type of naphthalenesulfonic acid/formaldehyde condensation products, to give a readily usable product. The use of liquid dye-like preparations of the oxidizing agent is, of course, not excluded by the present invention, indeed it is even advantageous. These preparations permit easy meterability and render it unnecessary to dissolve the products.

The quantities of oxidizing agent to be employed are preferably 0.3 to 5 g/l of sodium benzenesulfochloroamide or p-toluenesulfochloroamide if the process is carried out continuously, and 0.3 to 3% (relative to the weight of the goods) of sodium benzenesulfochloroamide or p-toluenesulfochloroamide if the process is carried out discontinuously.

The examples which follow serve to illustrate the invention, without the intention of limiting it thereto.

EXAMPLE 1

150 kg of cotton yarn on cheeses are treated in a yarn dyeing machine, at a liquor ratio of 1:10 and with an alternating direction of circulation, with an aqueous liquor containing-relative to the weight of the dry goods:

- 16% of the dyestuff Sulfur Red 6 of C.I. No. 53,720, in a form ready for dyeing, and
- 5 $cm^3/l$ of a 31% strength aqueous solution of sodium hydrogen sulfide (I),
- 5 $cm^3/l$ of an aqueous solution containing 20% of $Na_2S_x$ (x=2–5), 14% of $Na_2S$ and 3% of $Na_2S_2O_3$ (II),
- 1 g/l of anhydrous sodium carbonate (III),
- 2$cm^3/l$ of a low-foaming anionic wetting agent (IV) and
- 20 g/l of anhydrous sodium sulfate.

In order to carry out exhaustion dyeing, the cheese dyeing machine is charged with the dry goods, the bath is then made up with the auxiliaries (I–IV) at 30° C., this liquor is allowed to circulate initially for 10 minutes and the dyestuff is then added. The bath temperature is then raised to 90° C. and the sodium sulfate is added 10 minutes after the dyeing temperature chosen has been reached. After a further dyeing time of 35 minutes at 90° C., the bath and the goods are cooled to 70° C., after which the material to be dyed is subjected to clear-rinsing with overflowing water. The bath is then drained.

For developing the dyestuff, an aqueous oxidation bath is freshly prepared by adding 1 g/l of anhydrous sodium carbonate and 2 g/l of sodium p-toluenesulfochloroamide or sodium benzenesulfochloroamide, and the dyeing machine is charged with this liquor. The dyestuff which has been fixed on the goods as the leuco compound is now oxidized for 10 minutes at 40° C. by starting up the circulation, and the dyeing is rinsed with water and finished in the usual manner.

A uniform, well oxidized dyeing is obtained in this manner, even in the case of the dyestuff, which is known to be difficult to oxidize. On the other hand, if the oxidation of the same dyestuff is carried out in a known manner at pH 9–10 by means of hydrogen peroxide, only a so-called layering in which the outer layers of the cheeses are dyed more darkly than the inner layers, is produced on the dyed goods.

The development of the dyestuff by oxidation can also be carried out in the present case at a temperature of 15° C., under otherwise identical conditions.

EXAMPLE 2

A batch of 1,200 m of cotton twill is to be dyed continuously. An aqueous padding liquor containing 150 g/l of the dyestuff Sulfur Red 6 of C.I. No. 53,720, in a form ready for dyeing, 5 $cm^3/l$ of a 31% strength aqueous solution of sodium hydrogen sulfide, 3 $cm^3/l$ of an aqueous solution containing 20% of $Na_2S_x$ (x=2-5), 14% of $Na_2S$ and 3% of $Na_2S_2O_3$, 1 g/l of anhydrous sodium carbonate and 2 $cm^3/l$ of a low-foaming anionic wetting agent is made up for this purpose, and is raised to a temperature of 25° C.

The goods are now padded with the liquor thus prepared at a liquor pick-up of 80% (relative to the weight of the dry goods), the material to be dyed is then steamed continuously for 1 minute in saturated steam at 102° C., and the goods are then rinsed with cold water in 4 washing troughs of an open-width washing machine.

The development of the dyestuff by oxidation is carried out similarly in a compartment of the open-width washing machine which contains an aqueous liquor containing 2 g/l of sodium benzenesulfochloroamide or sodium p-toluenesulfochloroamide and 1 g/l of anhydrous sodium carbonate (pH 9-10), warmed to 40° C., a dwell time of 20 seconds being maintained for the passage of the goods. This oxidation bath is continuously made up to strength with an aqueous solution containing 0.5-1% of sodium benzenesulfochloroamide or p-toluenesulfochloroamide and anhydrous sodium carbonate in order to maintain a pH of 9. Finally, the dyeing is again given a warm (40° C.) and a cold water rinse (3-4 washing troughs) and is finished in the customary manner.

In spite of the difficulty of oxidizing the dye-stuff used, the dyeing thus produced is oxidized in a fault-free manner as comparisons with samples carefully oxidized in a known manner have shown.

I claim:

1. A process for the reoxidation, from an alkaline medium, of sulfur dyestuffs which have previously been applied, in a reduced form, to a textile material containing cellulose fibers and have been fixed thereto, which comprises exposing the fiber material which has been treated with the dyestuffs to the oxidative action of an aqueous solution of N-halogenated organic sulfonamides of the general formula

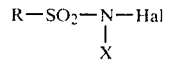

in which R denotes an aryl radical, Hal represents a halogen atom, and X represents a hydrogen atom or an alkali metal atom at a temperature between 15° and 98° C. and at pH values within the range from 8 to 12.

2. The process as claimed in claim 1, wherein the reoxidation is carried out within the pH range between 8 and 10.

3. The process as claimed in claim 1, wherein the reoxidation is carried out continuously.

4. The process as claimed in claim 1, wherein the reoxidation is carried out discontinuously.

5. The process as claimed in claim 1, wherein, in the case of continuous reoxidation, a dwell time of 5 to 120 seconds is maintained for the material to be dyed.

6. The process as claimed in claim 3, wherein the oxidizing agent used is 0.3 to 5 g/l of sodium benzenesulfochloroamide or p-toluenesulfochloroamide.

7. The process as claimed in claim 4, wherein the oxidizing agent used is 0.3 to 3% of sodium benzenesulfochloroamide or p-toluenesulfochloroamide.

8. The process as claimed in claim 1, wherein R denotes a phenyl or a lower alkylaryl radical and Hal represents a chlorine or bromine atom.

9. The process as claimed in claim 8, wherein said lower alkylaryl radical is a mono-($C_1$-$C_4$)-alkylphenyl or di-($C_1$-$C_4$)-alkylphenyl.

10. The process as claimed in claim 1, wherein Hal is a chlorine atom.

11. The process as claimed in claim 1, wherein X represents a sodium atom.

* * * * *